United States Patent [19]

Thaler

[11] Patent Number: 4,581,863

[45] Date of Patent: Apr. 15, 1986

[54] ROOF ANCHOR AND SUPPORT

[76] Inventor: Kenneth Thaler, 38-3500 Glenerin Dr., Mississauga, Ontario, Canada, L5L 1W6

[21] Appl. No.: 648,186

[22] Filed: Sep. 6, 1984

[30] Foreign Application Priority Data

Oct. 6, 1983 [CA] Canada ..... 438494

[51] Int. Cl.[4] ..... E04D 15/00; B66F 3/08

[52] U.S. Cl. ..... 52/126.2; 52/126.6; 52/365; 248/354.4; 248/357; 248/405; 248/354.3; 254/98

[58] Field of Search ..... 52/126.2, 126.6, 126.7, 52/365; 254/98, 100, 101, 92; 248/405, 351, 354 S, 357

[56] References Cited

U.S. PATENT DOCUMENTS

| | | | |
|---|---|---|---|
| 804,662 | 11/1905 | Johnston | 254/98 |
| 880,560 | 3/1908 | Milroy . | |
| 912,675 | 2/1909 | Hartley | 254/98 |
| 1,942,088 | 1/1934 | Dietrich | 254/98 |
| 2,359,000 | 9/1944 | Rosenzweig | 248/21 |
| 2,504,291 | 4/1950 | Alderfer | 254/98 |
| 2,665,104 | 1/1954 | Myers | 254/98 |
| 2,684,222 | 7/1954 | Miller | 254/98 X |
| 2,842,955 | 7/1958 | Pedersen | 72/77 |
| 3,027,140 | 3/1962 | Holzbach | 254/98 |
| 3,074,693 | 1/1963 | Shumake | 254/98 X |
| 3,190,041 | 6/1965 | Kimball | 50/185 |
| 3,222,030 | 12/1965 | Thorpe | 52/126.6 X |
| 3,758,058 | 9/1973 | Neudeck et al. | 248/20 |
| 3,831,329 | 8/1974 | Lear | 52/126.6 |
| 3,899,857 | 8/1975 | Mochizuki | 52/126.6 |
| 3,971,537 | 7/1976 | Winkle et al. | 248/23 |
| 4,120,129 | 10/1978 | Nagler et al. | 52/219 |

FOREIGN PATENT DOCUMENTS

| | | | |
|---|---|---|---|
| 999541 | 10/1951 | France | 52/365 |

*Primary Examiner*—Stanley N. Gilreath

*Attorney, Agent, or Firm*—Panitch Schwarze Jacobs & Nadel

[57] ABSTRACT

A variety of roof-mounted support apparatuses for supporting ducts, air conditioning units, roof access ladders, and walk-ways, each apparatus including a base plate mounted below the roof insulation, a vertical support member connected to the base plate and extending upwards therefrom, and a sleeve member that extends about the support member and has a flange extending outwardly from its bottom end. The flange is arranged above the insulation for the roof. A hollow cap member has an open bottom and fits on and over an upper end portion of the sleeve member. A threaded connecting member extends downwardly from a horizontally extending section of the cap member and is located within the cap member. The support member has means for threadedly receiving the connecting member and for thereby detachably connecting the cap member to the support member.

22 Claims, 19 Drawing Figures

ROOF ANCHOR AND SUPPORT

BACKGROUND OF THE INVENTION

This invention relates to roof-mounted support apparatus suitable for supporting such things as ducts, pipes, cables, air conditioning units, and roof access ladders.

In modern commercial and industrial buildings particularly those having flat roofs, it is often desirable to locate or mount a variety of structures on the roof of the building. For example often air conditioners are mounted on the roof and there may also be pipes or duct work. It may also be necessary to provide a means for attaching guy wires required to support chimneys, T.V. towers or the like. Further devices that may require support on a roof include roof access ladders and window cleaning safety lines. In constructing support apparatus for roofs, it is necessary that the apparatus not create any water leaks in the roof and that it have a long maintenance-free life. Another desirable characteristic for such supports, particularly with the present day high cost of energy, is that they not result in high heat losses due to a lack of insulation in the region of the support apparatus.

One known method for anchoring or supporting and flashing roof items is called the pitch pan method. A "pitch pan" anchor is provided by means of a centre support post mounted on a flat base plate and a separate circular or square sleeve member having a flange projecting from its bottom end. The sleeve member extends around the centre post and leaves a gap between itself and the post which is filled with mastic cement intended to provide a waterproof seal. There are severe maintenance problems with the use of this method because the mastic cement will soon dry and shrink and the shrinking can leave a gap between the cement and either the post or the sleeve member. Also if the post moves slightly for any reason, a gap through which water can leak will be created. It is not uncommon for a roof support constructed in accordance with the pitch pan method to require maintenance or repair after as little as nine months from the initial installation or the last repair thereto.

Early U.S. Pat. No. 880,560 issued Mar. 3, 1908 to Sidney Milroy teaches a support for mounting a hand pump on a concrete base. The support includes a hollow cylinder having angle strips extending outwardly therefrom, which strips are embedded in the concrete. The upper end of the cylinder is threaded and is connected by the threads to a flange member. By means of holes in the flange and bolts, the base of the pump can be connected to the flange.

A much more recent U.S. Pat. No. 4,120,129 issued Oct. 17, 1978 to W. M. Nagler describes a special flashing unit designed for use on a roof and arranged about a vertical pipe extending through the roof. The unit is not intended for anything other than the provision of weather-proof egress for a single pipe. The unit has a hollow housing and an integral circular base flange. The housing tapers outwardly from the upper end to the flange. There is also a hollow sealing element having a number of concentric upstanding stepped sections. The bottom of the sealing element is sized to closely fit the upper end of the housing to which it can be clamped by means of a standard pipe clamp.

It is an object of the present invention to provide a reliable roof-mounted support apparatus having a long, useful life and adaptable by means of various embodiments for the support of a number of common roof items.

It is a further object of the invention to provide a novel roof-mounted support apparatus wherein the likelihood of a water leak developing around or through the support apparatus is substantially reduced, if not eliminated.

SUMMARY OF THE INVENTION

According to one aspect of the present invention, a roof-mounted support apparatus comprises a base plate, a vertical support member connected to said base plate and extending upwards therefrom, and a sleeve member adapted to extend about said support member and having a flange extending outwardly from its bottom end. There is also a hollow cap member having an open bottom and adapted to fit on and over at least an upper end portion of the sleeve member. A threaded connecting member extends downwardly from a horizontally extending section of the cap member and is located within the cap member. The support member has means for threadedly receiving the connecting member and for thereby detachably connecting the cap member to the support member.

Preferably the support member is a metal tube rigidly connected to the centre of the base plate. The receiving means can be a metal plug welded in the upper end of the tube. The cavity in the cap member is circular in horizontal cross section and the connecting member extends axially through the centre of the cavity.

According to another aspect of the invention, a roof-mounted support apparatus comprises a base plate, a vertical support member connected to the base plate and extending upwards therefrom, and a sleeve member adapted to extend about the support member and having a flange extending outwardly from its bottom end. There is also provided a hollow cap member having an open bottom and adapted to fit on and over at least an upper portion of the sleeve member. The cap member has a threaded connecting member extending downwardly and located within the cap member. The support member has means for threadedly receiving the connecting member in order to connect the cap member to the support member.

Preferably the cap member forms a leak-proof cover for the upper end of the sleeve member whereby water is prevented from entering into the interior of the sleeve member when the cap member is connected to the support member.

Further features and advantages will be apparent to those skilled in the present art from the following detailed description of various preferred embodiments taken in conjunction with the accompanying drawings.

DETAILED DESCRIPTION OF PREFERRED EMBODIMENTS

Figure 1:
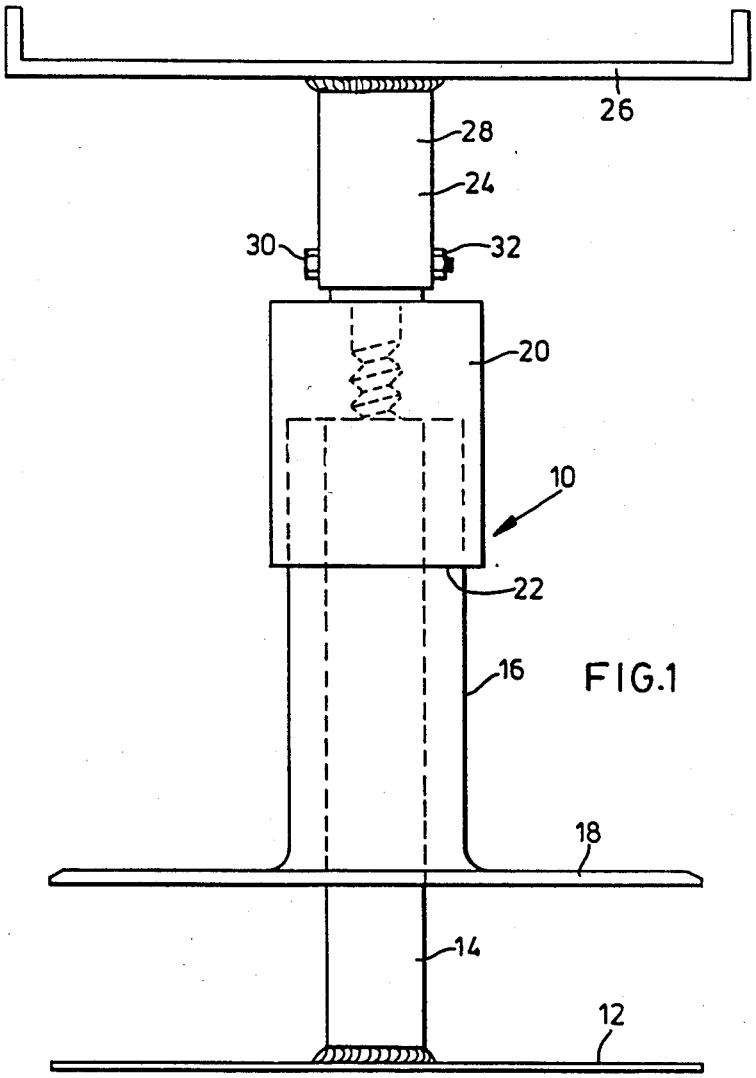
FIG. 1 is a front elevation of one embodiment of the roof-mounted support apparatus.
Figure 2:
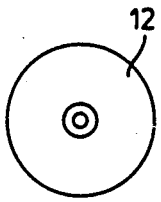
FIG. 2 is a top view, on a smaller scale, of the support member or post member shown in FIG. 1.

In the drawings and the following detailed description the same reference numerals will be used to denote the same or essentially the same part or feature.

Figure 3:
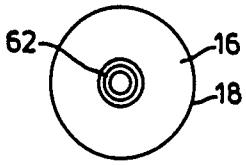
FIG. 3 is a top view of the sleeve member shown in FIG. 1.
Figure 5:
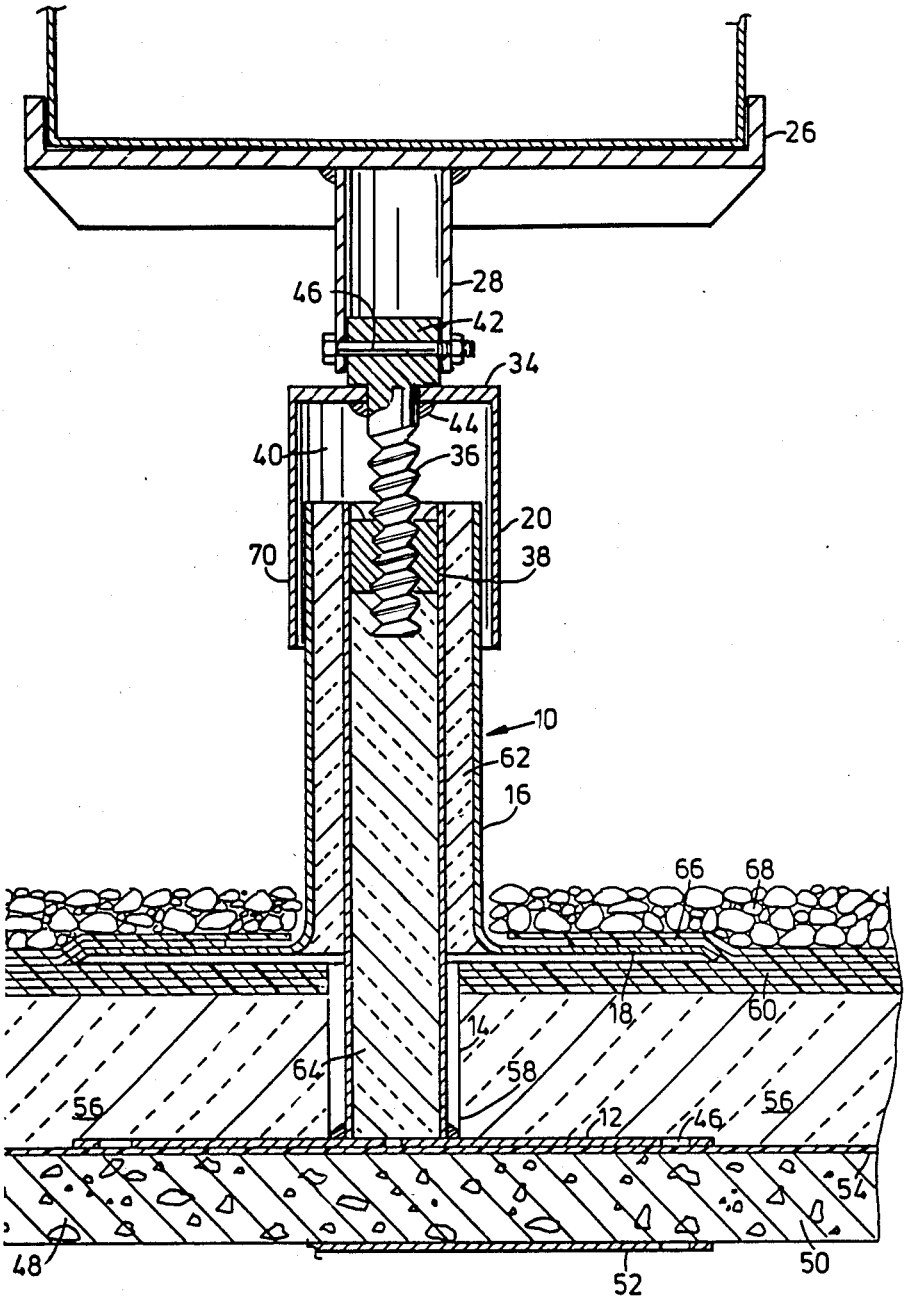
FIG. 5 is a sectional view of the support apparatus of FIG. 1, the view being taken along the central vertical axis of the apparatus and showing how the apparatus is mounted on a roof.
Figure 6:
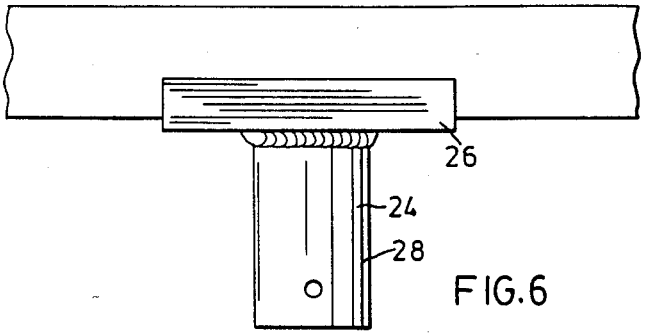
FIG. 6 is a side view of the T-bar support at the top of the apparatus shown in FIG. 5.

In FIG. 1, there is shown a roof-mounted support apparatus 10 adapted for the support of a duct such as a heating duct on a typical flat roof, the nature of which can be seen from FIG. 5. The basic components of the apparatus include a base plate 12 which is preferably constructed of steel for strength, and a vertical support member or post 14 connected to the base plate 12 and extending upwards therefrom. Preferably the support member is welded to the base plate and comprises a hollow steel pipe. In addition the apparatus includes a sleeve member 16 adapted to extend about the support member 14 and having a flange 18 extending outwardly from its bottom end. As shown in FIG. 3, the flange 18 can be circular as can be the base plate 12. It is equally possible for the members 12 and 18 to be square or rectangular when viewed from the top. Arranged at the top end of the sleeve member 16 is a hollow cap member 20 having an open bottom 22. The cap member is adapted to fit on and over at least an upper end portion of the sleeve member 16. Detachably mounted on top of the cap member is a "T" bar support. The support 24 includes a horizontally extending bracket 26, the width of which can be varied depending upon the width of the duct, and a post section 28, the length of which can be varied as required. The bottom end of the post section 28 is connected to the cap member 20 by means of a bolt 30 and a nut 32. A side view of the support 24 can be seen in FIG. 6. The bracket 26 can be rigidly attached to the post section by means of welding.

Figure 4:
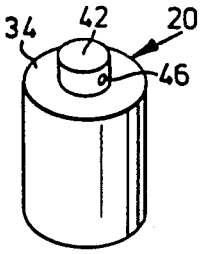
FIG. 4 is a perspective view of the cap member shown in FIG. 1.

The cap member 20 will now be described in greater detail with reference to FIGS. 4 and 5. Preferably the cap member 20 is circular in horizontal cross section and has a closed top end 34 which keeps water and moisture from entering the top of the sleeve member 16 and the support member 14. The cylindrical wall and top end of the cap member can be made with mild steel. Located inside the cap member is a threaded connecting member 36 extending downwardly from the horizontally extending section of the cap member which forms the top 34. The support member 14 has means for threadedly receiving the connecting member 36 and for thereby detachably connecting the cap member 20 to the support member. Preferably the receiving means comprises a solid steel threaded plug 38 welded firmly in place in the upper end of the member 14. It is desirable that the connecting member 36 have a sufficient length of threads to permit at least 2 inches of vertical adjustment to the cap member. Because the cavity 40 in the cap member has a circular horizontal cross section as does the exterior of the sleeve member 16, it will be seen that it is a relatively simple step to attach the cap member to the support member 14 by a simple turning of the cap member about its central axis. A mounting device 42 is arranged at the top end of the cap member and is supported thereby. In this embodiment the mounting device can be an upwards extension of the connecting member 36, there being a hole in the top end 34 of the cap member to accommodate the extension. Any gap between the connecting member 36 and the plate forming the top end 34 is completely sealed by the welding at 44. The mounting device 42 has a circular shape and is sized to fit snugly into the bottom end of the post 28. A hole 46 extends therethrough to accommodate the bolt 30 which preferably is made of stainless steel.

In order to install the support apparatus 10, the base plate 12 has holes 46 formed therein to accommodate bolts or studs. The plate 12 is rigidly mounted to the top surface of the concrete deck 48 or the steel deck 50 that forms the roof. In the case of a steel deck, an additional mounting plate 52 can be used to connect the base plate 12. The additional plate 52 can be of the same size as the plate 12 and have holes in line with the holes 46. It will be appreciated that bolts (not shown) are then inserted through the holes 46, through the steel deck 50 and through the holes in the plate 52 in order to firmly mount the base plate 12. With a concrete deck, the bolts or studs are simply embedded in the concrete so that the threaded ends project from the top surface thereof at the locations required to mount the plate 12. A vapour barrier 54 should be put in place on top of the concrete or steel deck before the plate 12 is connected. After the base plate 12 is mounted, rigid insulation 56 can be laid on the roof in a well known manner. A hole 58 is formed in this insulation to accommodate the support member or post 14. The rigid insulation is then covered with layers of protective material 60 in a well known manner.

The next step is to install the sleeve member 16 which comes from the factory with an inner layer of urethane insulation 62. The circular passageway formed by the insulation has a diameter substantially equal to or slightly greater than the diameter of the support member 14 which is thus able to slide upwards through the passageway. Preferably the inside of the support member 14 is also filled with urethane insulation 64. The primary reason for the insulation 62 and 64 is to prevent condensation from occurring inside of the members 14 and 16. It may also prevent some heat loss that would otherwise occur through the hole 58 in the insulation 56. The insulation 62 also helps to centre the sleeve member 16 on the member 14. After installation of the sleeve member 16, the roof itself can be completed. As illustrated in FIG. 5, three layers of felt flashing 66 can be applied around the flange 18 which preferably is bituminous painted. The flange is mopped into place using the plies of felt. In the case of single-ply roofs, the flange 18 can be supplied without bituminous paint and in this case a roof membrane is applied over the flange and extends up the sleeve to the underside of the cap member 20. In this case, the collar of the cap member is fabricated slightly oversized to accommodate the membrane. A final layer of stones 68 can be applied to the top of the roof to form a suitable exterior surface.

After installation of the sleeve member, it is then possible to connect the cap member 20 by threading the connecting member 36 into the hole in the plug 38. This is accomplished by rotating the entire cap member 20 about its central axis. Because the collar 70 of the cap member overlaps the upper end of the sleeve member to some extent, there is no possibility of water entering into either the sleeve member or the support member 14. Preferably each of the cap members disclosed herein is made of galvanized steel for long life. The sleeve member 16 is preferably made of aluminum or copper, which materials also have a long life under exposed conditions. It is further desirable that the anchor or support member 14 be protected by an exterior layer of bitumen primer.

Figure 7:
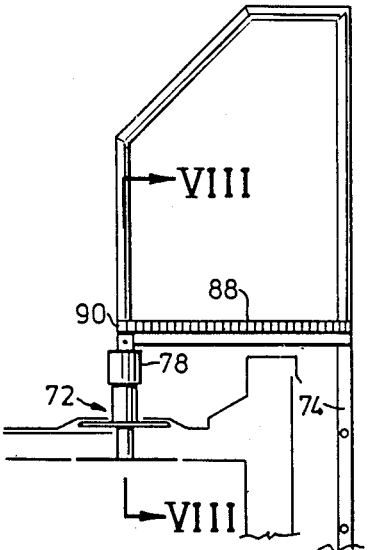
FIG. 7 is a schematic illustration showing how a support apparatus constructed in accordance with the present invention can be used to support a roof access ladder.
Figure 8:
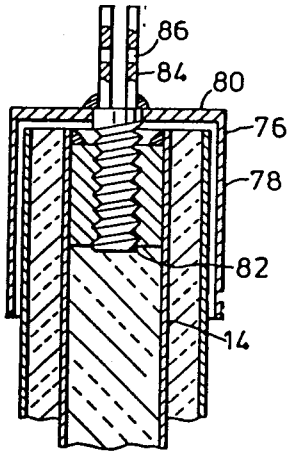
FIG. 8 is a sectional view of the support apparatus shown in FIG. 7, the view being taken along the line VIII—VIII in FIG. 7.

Turning now to the embodiment shown in FIGS. 7 and 8, a support apparatus 72 suitable for mounting a roof access ladder 74 is constructed in the same fashion as the apparatus 10 shown in FIGS. 1 and 5 except for the construction of its cap member 76. Accordingly only the cap member 76 will be described in detail herein. The member 76 has a cylindrical collar 78 and a closed top end 80. A threaded connecting member 82 extends downwardly from the top end 80 and along the centre axis of the cap member. As with the previous embodiment this connecting member 82 is threaded into a steel plug mounted in the top end of the support member 14. Projecting upwardly from the top end 80 are two spaced apart connecting lugs 84 having holes 86 to accommodate connecting bolts. Preferably the lugs are welded to the plate forming the top end 80. It will thus be seen that the ladder platform 88 can be connected by means of suitable nuts and bolts to the top of the support apparatus 72. Typically there can be two apparatuses 72, one on each side of the end 90 of the ladder platform.

Figure 9:
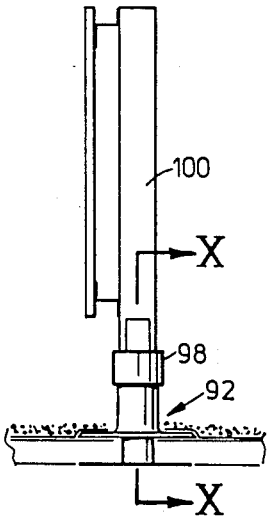
FIG. 9 is a schematic illustration of a further embodiment of the suuport apparatus showing how the apparatus can be used to mount an air conditioning unit screen.
Figure 10:
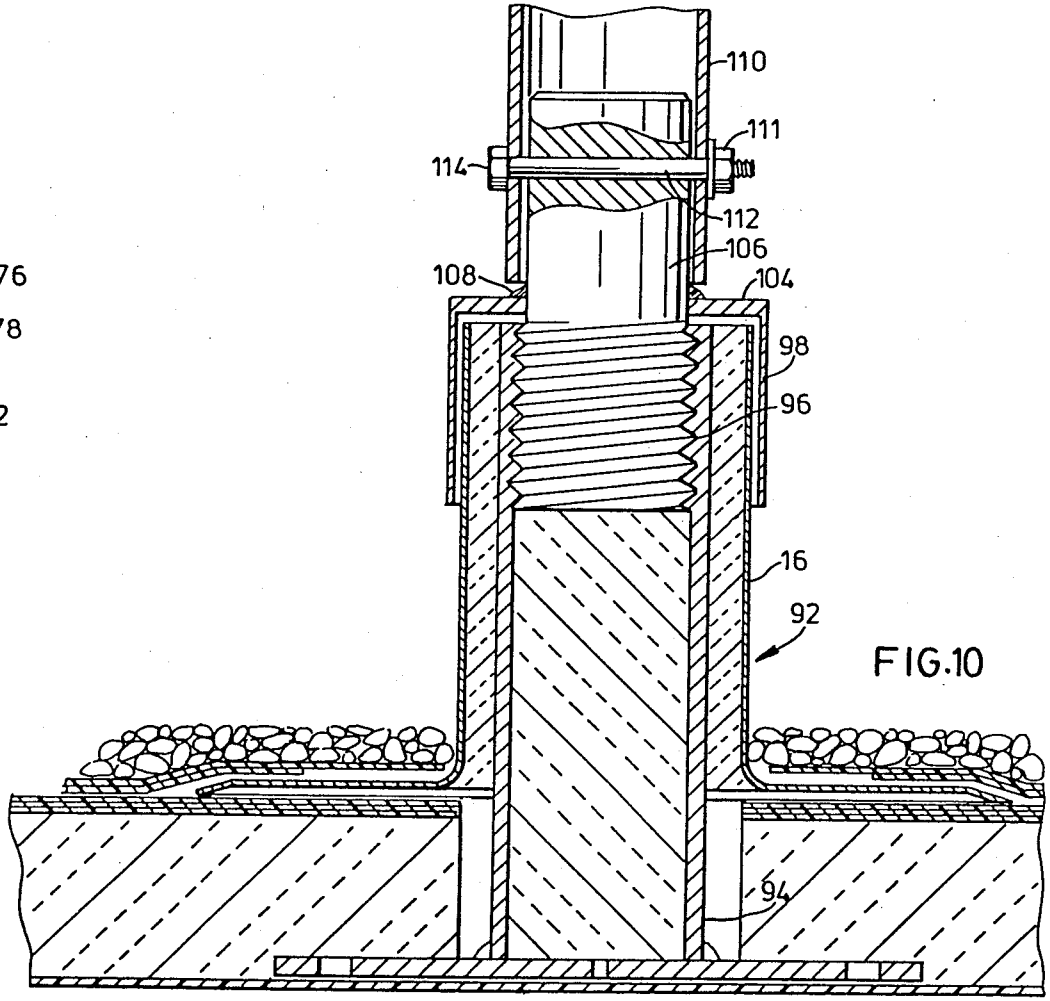
FIG. 10 is a sectional elevation of the support apparatus shown in FIG. 9, the view being taken along the line X—X of FIG. 9.

In the embodiment shown in FIGS. 9 and 10, the support apparatus 92 has a sleeve member 16 similar in its construction to those in the embodiments already discussed. However, the support member or post 94 differs somewhat from the support member 14 shown in FIG. 5. In the member 94, there is no plug welded into the top end of the member. Instead the member 94 which is formed from a steel tube is internally threaded at its upper end at 96.

A cap member 98 adapted for the support of an air conditioning unit screen 100 has a relatively wide, connecting member 102 extending downwardly from a horizontally extending section 104 of the cap member. The connecting member has threads which mate with those at the upper end of the support member 94. Thus the cap member 98 can be detachably connected to the member 94 by rotation of the cap member about its vertical centre axis. Projecting upwardly from the horizontal section 104 is a solid steel stud 106. When the diameter of the stud 106 can correspond substantially with that of the connecting member 102, the stud can be an upward extension of the connecting member and a hole can be formed in the horizontal section 104 to accommodate this extension. Any gap between the member forming the stud 106 and the hole in the section 104 is closed by a weld 108. The stud fits into the end of a structural support 110 for the screen. A bolt hole 112 extends transversely through the stud 106 and is aligned with holes formed in the support 110. A bolt 114 and nut 111 are used to connect the stud to the support 110.

Figure 11:
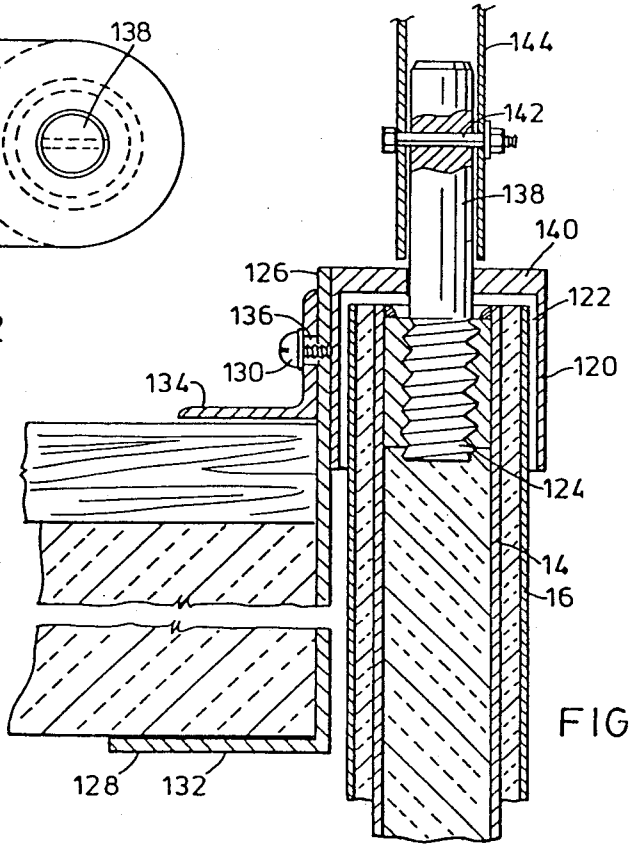
FIG. 11 is a sectional elevation taken along the vertical centre axis and showing the top portion of an embodiment of the invention adapted for the support of a walk-way.
Figure 12:
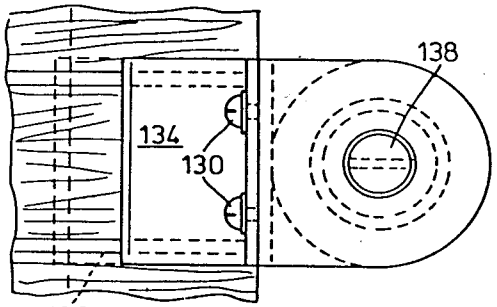
FIG. 12 is a plan view of the upper portion of the support apparatus shown in FIG. 11.

The embodiment of the present invention shown in FIGS. 11 and 12 is designed for the support of a walkway on a roof or deck, the surface of which is not suitable for walking on. Only the upper portion of the support apparatus is shown in FIG. 11 as the bottom portion of the apparatus is the same as that of the embodiment shown in FIG. 5. In fact only the cap member 120 is different in its construction. The cap member has a cavity 122 that is circular in its horizontal cross section and that is sized to fit over the upper end portion of the sleeve member 16. The cap member has an internal, threaded connecting member 124 which is threaded into the plug welded into the upper end of the support member 14. The cap member is flat along one side at 126. A walkway support structure 128 is connected to the flat side 126 by any suitable means such as welding. In the illustrated embodiment the walkway support structure includes a large steel angle member 132 providing a bottom support for the walkway and a smaller steel angle member 134 to cover the edge of the upper surface of the walkway. The holes 136 in the angle member 134 can be in the form of a vertically extending slots to provide a means for vertical adjustment before the studs 130 are tightened. The overall height of the angle member 132 can vary depending upon the requirements of the particular walkway to be installed.

It may also be desirable to provide a steel or other form of guardrail along the walkway, particularly if the walkway runs close to the edge of the roof. In order to provide a support for the guardrail, an anchor stub 138 can extend from the horizontally extending section 140 of the cap member. The stud can have a circular cross section and a transverse bolt hole 142. A steel pipe 144 forming a post for the guardrail extends over the anchor stub and is firmly connected thereto by means of a nut and bolt.

Figure 13:
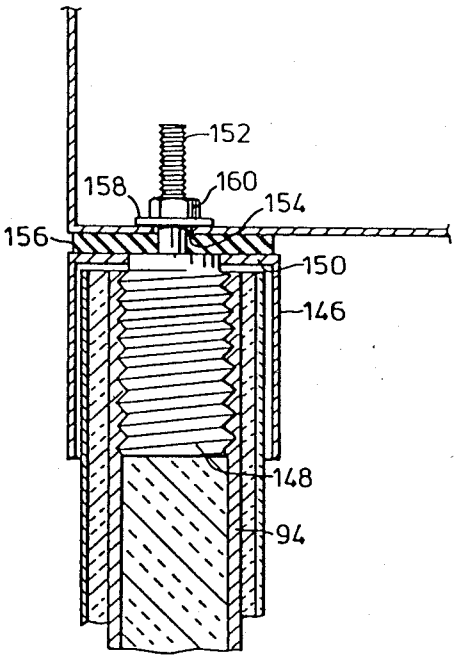
FIG. 13 is a sectional elevation of another form of cap member constructed for the support of an air conditioning unit.

FIG. 13 shows another form of cap member 146 that is particularly suitable for supporting an air conditioning unit on a roof. It will be appreciated that the remainder of the support apparatus for the air conditioning unit is the same as that shown in FIG. 10. As in the FIG. 10 embodiment, the cap member has a relatively large diameter connecting member 148 that is threadedly received into the upper end of the support member 94. The cap member has a horizontally extending section 150 from which projects a threaded stud 152. The bottom plate of the air conditioning unit has a hole 154 formed therein to accommodate the stud 152. Preferably before the air conditioning unit is placed in position on the support apparatus, a rubber isolator 156 is placed on the section 150 of the cap member. This isolator absorbs the vibration created by the operation of the air conditioner and reduces the amount of noise created. After the air conditioning unit is mounted on the support apparatuses in the manner shown in FIG. 13, the attachment of the unit is completed by placement of a washer 158 and a nut 160 on the stud 152. It will be appreciated that four or more support apparatuses may be required to support a single air conditioning unit.

Figure 14:
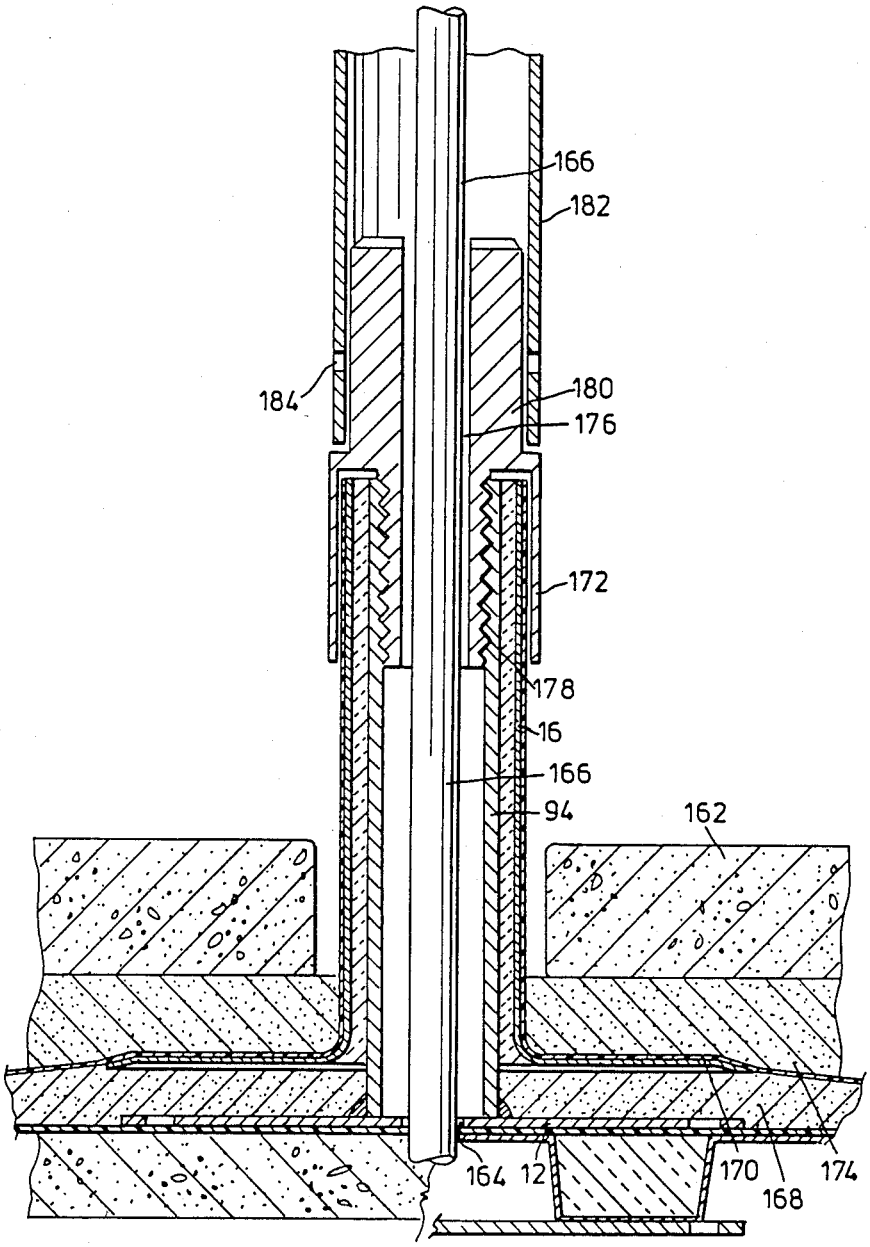
FIG. 14 is a sectional elevation taken along the vertical centre axis showing another embodiment constructed for the support of a light standard.

In FIG. 14 there is shown a base for a light standard constructed in accordance with the present invention. Such a light standard is often required for a terrace that may be covered with patio stones 162. The terrace can either be constructed from a concrete deck or a steel deck in a manner similar to the construction of a roof. In the embodiment shown in FIG. 14, the support member 94 is constructed in the same manner as that shown in FIG. 10 except that the cavity in the member is not filled with urethane insulation but is left hollow. Also the base plate 12 may have a larger central opening 164 to accommodate a rigid electrical conduit 166. The support apparatus has a sleeve member 16 constructed in essentially the same manner as that shown in FIG. 10. However, for purposes of a terrace, the sleeve member 16 is mounted in a different manner than it is for purposes of a roof. After the support member 94 is firmly connected to the steel or concrete deck, it is covered with at least one inch of cement grout 168. After this grout has hardened, the sleeve member 16 is then put in place with its outwardly extending flange resting on the grout. A waterproof membrane 170 is then installed over the grout and over the flange of the sleeve. This membrane extends up the sleeve to the underside of the cap member 172. Suitable sand or gravel 174 is placed over the membrane and levelled to accommodate the patio stones.

The cap member 172 is similar to the cap member 98 shown in FIG. 10 except that it has a central vertical passageway 176 to accommodate the conduit 166. The passageway 176 extends through the threaded connecting member 178 and the large stud 180. The bottom end of the light standard 182 fits over the stud and can be held in place by bolts (not shown) extending through openings 184. The stud or steel core 180 can be drilled and tapped to accommodate the bolts.

Figure 15:
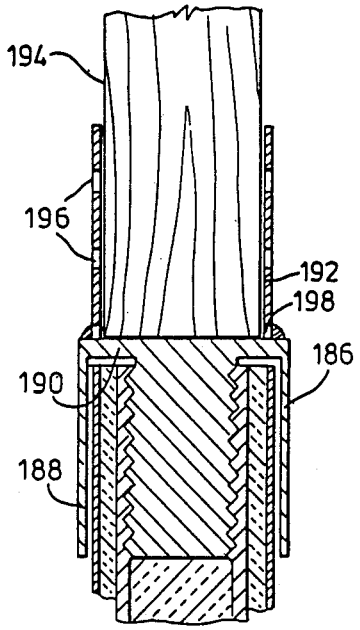
FIG. 15 is a sectional elevation showing the upper end of another form of support apparatus that can be used to support a trellis.

FIG. 15 shows the upper end of a trellis support apparatus or anchor. This support apparatus is constructed and mounted in the same manner as that shown in FIG. 14 except for the construction o the cap member 186. The cap member has a cylindrical collar 188 and a horizontally extending section 190. Extending downwardly from the section 190 is a threaded connecting member. Extending upwardly from the section 190 is a hollow cylindrical member 192 that can be welded in place. A round wooden post 194 for a trellis or other structure has its bottom end held by the member 192. If the post 194 is square in cross section, then the member 192 can also have a square cross section. Holes 196 can be provided in the member 192 in order to accommodate bolts (not shown). Preferably weep holes 198 are provided at the bottom of the member 192 to permit water to escape.

Figure 16:
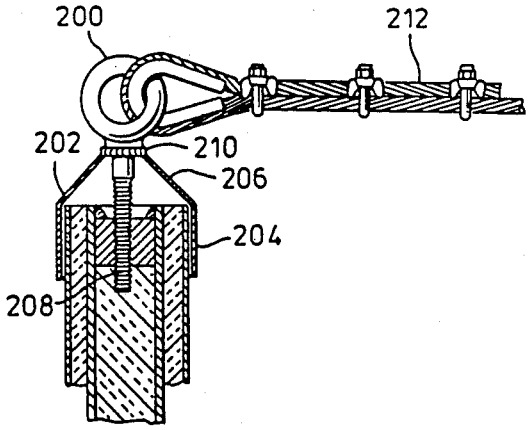
FIG. 16 is a sectional elevation taken along the vertical centre line showing the upper portion of another embodiment adapted for holding the end of a window cleaning safety line.

FIG. 16 illustrates how a support apparatus constructed in accordance with the present invention can accommodate an eye bolt 200. Except for the cap member 202, the support apparatus of this embodiment is constructed in the same fashion as that shown in FIG. 5. The cap member has a cylindrical collar 204 extending downwardly from a conical upper portion 206. The eye of the bolt 200 is mounted at the top end of the upper portion 206 and is located outside the cavity formed by the cap member. The threaded portion of the eye bolt 200 forms the connecting member 208. A continuous weld 210 rigidly connects the eye bolt to the conical portion 206. Such a support apparatus can be used to hole the terminal end of a wire cable or rope window cleaning safety line 212.

Figure 17:
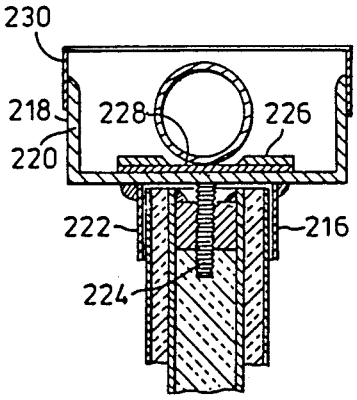
FIG. 17 is a sectional elevation taken along the vertical centre line showing the upper portion of still another embodiment constructed to support a pipe or conduit.

FIG. 17 shows another embodiment of the present invention capable of supporting small to medium size pipe or conduit. The support apparatus of this embodiment is constructed in the same manner as that shown in FIG. 5 except for the cap member 216. The cap member is characterized by the fact that the top end of the cavity is formed by a steel channel 218 having upwardly extending side flanges 220. The channel 218 is welded to a galvanized steel collar 222 which may be painted with aluminum paint. A threaded connecting member 224 is rigidly connected to the bottom surface of the channel 218 and is arranged so that it extends along the vertical axis of the collar 222. A brass saddle 226 can be arranged centrally in the channel 218. The saddle forms a recess 228 in which the pipe or conduit sits. The saddle is fabricated from three brass plates of equal thickness, i.e. 6 mm or $\frac{1}{4}$ inch. The upper surface of the saddle can be coated with oil if desired to reduce friction between the brass and the conduit. If desired, one or more retaining straps 230 can be attached to the flanges 220 to hold the conduit in place. These straps are preferably attached by means of nuts and bolts so that they can later be removed if pipe replacement is required.

Figure 18:
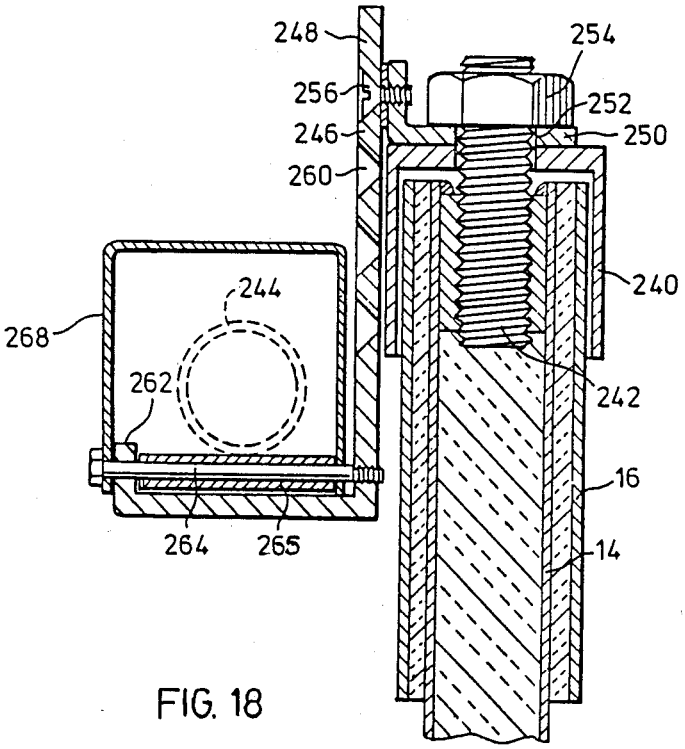
FIG. 18 is a sectional elevation showing the upper portion of a further embodiment designed to support a pipe.
Figure 19:
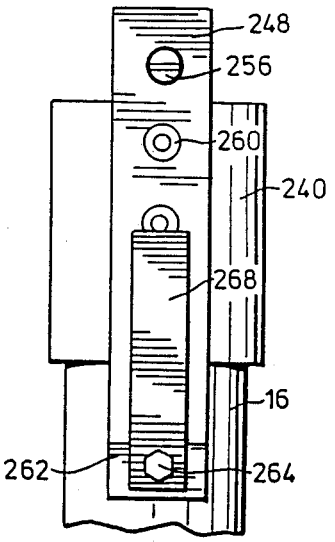
FIG. 19 is a left side view showing the embodiment of FIG. 18.

In the preferred embodiment of FIGS. 18 and 19, the support member 14 and the sleeve member 16 are constructed as described previously. A hollow cap member 240 has a threaded connecting member 242 extending through its top and rigidly mounted therein. Means are provided for detachably mounting a section of the pipe 244 at one side of the support apparatus. The mounting means includes a L-shaped mounting bracket 246 preferably constructed from strong, rigid steel. The vertical leg 248 of the bracket is detachably connected to the top of the cap member 240. A L-shaped connecting member 250 has a hole 252 formed in a horizontal leg and through this hole the threaded member 242 extends. The member 250 is connected to the top of the cap member by a nut 254. A threaded fastener 256 extends through one of a series of holes distributed along the length of vertical leg 248 and connects the bracket 246 to the member 250. It will thus be seen that the height of the bracket 246 can be varied by the selection of one of the holes 260.

The preferred form of the bracket 246 has an upturned end 262 with a hole therein to receive long bolt 264. The vertical leg 248 has another hole at its bottom end to receive the threaded end of the bolt 264. Mounted on the bolt and free to rotate thereon is a roller 266 which extends horizontally just above the horizontal leg of the bracket. Because the roller is in direct contact with the pipe section 244 and is free to rotate, the roller will permit easy longitudinal movement of the pipe section, which movement can result from thermal expansion or contraction. Also mounted on the bolt 264 is a U-shaped bracket 268 adapted to surround the pipe section. The distinct advantage of the embodiment shown in FIGS. 18 and 19 is that it permits the pipe to be mounted reasonably close to the roof surface and the support apparatus does not require much height clearance in order to be used on the roof.

It will be readily apparent to those skilled in the present art that various other modifications and embodiments of the support apparatus of the present invention can be constructed. It is clear that the present support apparatus can be used to support a wide variety of items on a roof or terrace. All such modifications and variations that fall within the scope of the appended claims are intended to be covered by the present application.

What I claim as my invention is:

1. A roof-mounted support apparatus comprising a base plate, a vertical support member connected to said base plate and extending upwards therefrom; a sleeve member adapted to extend about said support member and having a flange extending outwardly from its bottom end, a hollow cap member having an open bottom and adapted to fit on and over at least an upper end portion of said sleeve member, and a threaded connecting member extending downwardly from a horizontally extending section of said cap member and located within said cap member, wherein said support member has means for threadedly receiving said connecting member and for thereby detachably connecting said cap member to said support member.

2. A roof-mounted support apparatus according to claim 1 wherein said support member is a metal tube rigidly connected to the centre of said base plate and said receiving means is a metal plug fastened in the upper end of said tube.

3. A roof-mounted support apparatus according to claim 2 wherein the cavity in said cap member is circular in horizontal cross-section and said connecting member extends axially through the centre of said cavity.

4. A roof-mounted support apparatus according to claim 1 including a mounting device arranged at the top end of said cap member and supported by said cap member.

5. A roof-mounted support apparatus according to claim 1 wherein the inside surface of said sleeve member is covered with insulation.

6. A roof-mounted support apparatus according to claim 2 wherein said metal tube is substantially filled with insulation in the base of said tube below said plug.

7. A roof-mounted support apparatus according to claim 1 wherein the inside surface of said sleeve member is covered with rigid urethane insulation.

8. A roof-mounted support apparatus according to claim 1 wherein said cap member has a hollow cylindrical member projecting upwardly from said horizontally extending section of said cap member.

9. A roof-mounted support apparatus according to claim 1 wherein said cap member has a walkway support struture detachably connected to one side thereof.

10. A roof-mounted support apparatus according to claim 1 wherein connecting lugs project from a horizontal top plate forming said horizontally extending section.

11. A roof-mounted support apparatus according to claim 1 including a T-shaped supporting member detachably connected to the upper end of said cap member and adapted to support a duct, pipes or conduits.

12. A roof-mounted support apparatus according to claim 1 wherein said cap member includes a solid stud projecting upwardly from said horizontally extending section of said cap member, said stud being an upward extension of said threaded connecting member and having a bolt hole extending transversely therethrough.

13. A roof-mounted support apparatus according to claim 1 wherein a threaded stud projects upwardly from said horizontally extending section of said cap member.

14. A roof-mounted support apparatus according to claim 1 wherein said horizontally extending section of said cap member is formed by a steel channel having upwardly extending side flanges.

15. A roof-mounted support apparatus comprising a base plate, a vertical support member connected to said base plate and extending upwards therefrom, a sleeve member adapted to extend about said support member and having a flange extending outwardly from its bottom end, and a hollow cap member having an open bottom and adapted to fit on and over at least an upper portion of said sleeve member, said cap member having a threaded connecting member extending downwardly and located within said cap member, wherein said support member has means for threadedly receiving said connecting member in order to connect said cap member to said support member.

16. A roof-mounted support apparatus according to claim 15 wherein said cap member forms a leak-proof cover for the upper end of said sleeve member whereby water is prevented from entering into the interior of said sleeve member when said cap member is connected to said support member.

17. A roof-mounted support apparatus according to claim 16 wherein said support member is a metal tube rigidly connected to the centre of said base plate and said receiving means is a metal plug fastened in the upper end of said tube.

18. A roof-mounted support apparatus according to claim 16 wherein said cap member has a conical upper portion and a cylindrical lower portion and said threaded connecting member is an eye bolt, the eye of which is mounted at the top end of said upper portion and is located outside the cavity formed by said cap member.

19. A roof-mounted support apparatus according to claim 17 wherein said cap member has a conical upper portion and a cylindrical lower portion and said threaded connecting member is an eye bolt, the eye of which is mounted at the top end of said upper portion and is located outside the cavity formed by said cap member.

20. A roof-mounted support apparatus according to claim 17 including means for detachably mounting a section of pipe at one side of said appratus.

21. A roof-mounted support apparatus according to claim 20 wherein said mounting menas comprises a L-shaped mounting bracket having vertical and horizontal legs, said vertical leg being detachably connected to the top of said cap member and having a number of bolt holes distributed along its length, and a threaded fastener adapted to extend through one of said holes to connect said bracket to said cap member.

22. A roof-mounted support apparatus according to claim 21 wherein a roller for direct support of said pipe section is mounted horizontally on said bracket above said horizontal leg.

* * * * *